United States Patent [19]

Hamlin

[11] Patent Number: 4,515,357

[45] Date of Patent: May 7, 1985

[54] PADDLE RETARD FEEDER

[75] Inventor: Thomas J. Hamlin, Macedon, N.Y.

[73] Assignee: Xerox Corporation, Stamford, Conn.

[21] Appl. No.: 446,740

[22] Filed: Dec. 3, 1982

[51] Int. Cl.[3] ..... B65H 3/06

[52] U.S. Cl. ..... 271/120; 271/121; 271/245

[58] Field of Search ..... 271/21, 114, 119, 120, 271/121, 245

[56] References Cited

U.S. PATENT DOCUMENTS

| | | | |
|---|---|---|---|
| 1,978,056 | 10/1934 | Nelson | 271/120 |
| 2,470,017 | 5/1949 | Clark | 271/120 |
| 3,572,691 | 3/1971 | Heinricy | 271/23 |
| 3,593,988 | 7/1971 | Collins | 271/119 |
| 3,630,516 | 12/1971 | Hong | 271/36 |
| 3,669,447 | 6/1972 | Turner et al. | 271/53 |
| 3,847,385 | 11/1974 | Wielock | 271/121 |
| 4,126,305 | 11/1978 | Colglazier et al. | 271/120 |
| 4,175,741 | 11/1979 | Colglazier et al. | 271/3.1 |
| 4,269,404 | 5/1981 | Webb | 271/42 |
| 4,381,860 | 5/1983 | Silverberg | 271/120 |

*Primary Examiner*—Richard A. Schacher

*Attorney, Agent, or Firm*—William A. Henry, II

[57] ABSTRACT

A friction retard feeder adapted to feed sheets from a stack into a paper path located in a horizontal plane includes a tray which holds a stack of sheets at an angle of between 15° and 20° with respect to the paper path. A paddle wheel having a plurality of blades is positioned a predetermined distance in front of sheets stacked in the tray so that as the paddle wheel is rotated the blades in a first position strike the top sheet in the stack in a plane parallel to the top of the stack and separates it from the remaining sheets in the stack. Continued rotation of the paddle wheel causes the blades to deflect downward in front of the stack and thereby inhibit movement of sheets other than the top sheet from the stack. The tray also includes a high friction surfaced pad that cooperates with the paddle wheel in order to enhance the feeding of sheets near the bottom of the tray.

13 Claims, 3 Drawing Figures

PADDLE RETARD FEEDER

This invention relates generally to an electrophotographic printing machine, and more particularly concerns an improved paddle wheel substrate feeding system for feeding substrates, which term is used herein to include sheets of any type, from a stack along a predetermined path.

Several types of sheet feeders have been used in the past with varying degrees of success. For example, sheet separation with a belt and retard roller appear in the sheet handling art at least as early as 1916 in U.S. Pat. No. 1,167,367 to P. L. Wells and, more recently, in 1969 U.S. Pat. No. 3,469,834 to Stange et al. The separation belt and retard roller are employed in these patents for queuing and advancing the sheets but not for separating them from the stack. In these patents, the region of contact between the roller and belt form a sheet queuing throat which is able to "fan out" or queue sheets passed through it. The sheets are separated from a stack and fed to the throat by a presser foot in the Wells, U.S. Pat. No. 1,167,367 and by a nudger or feed wheel in the Stange et al., U.S. Pat. No. 3,469,834.

In addition, numerous devices such as impact/paddle feeders of the type disclosed in U.S. Pat. No. 3,630,516 have been employed to minimize the possibility of misfeeds or multi-feeds. The continued search for feeders that minimize mis-feeds and multi-feeds and can handle wider ranges of copy paper or documents has been necessitated by the complexity of modern sheet processing machines, such as, printers, sorters, collators, reproduction machines, etc., since a mis-feed or multi-feed causes machine shut downs. As an improvement, the present top feeder combines a paddle wheel which is positioned forward of a stack of substrates that are supported in a tray at an angle with respect to a horizontal plane. A friction surfaced means extends partially into and out of the tray in order to enhance the feeding of substrates individually from the tray regardless of stack heights.

Accordingly, in one aspect of the present invention, an inertial friction retard feeder comprises in combination, tray means for holding a stack of sheets to be fed, said tray means being positioned with respect to a horizontal plane at an angle of about 15° to about 20°, friction surfaced means along the bottom of said tray means extending partially under the stack and adapted to allow the stack of sheets to be placed thereon for feeding, and paddle wheel means positioned in front of the stack and located in driving relation to all sheets in the stack such that as the paddle wheel is rotated the blades on the paddle wheel are deflected by the stack along the front edge of the stack to such a point that only a single sheet separates a blade from said friction surface means.

The foregoing and other features of the instant invention will be more apparent from a further reading of the specification and claims and from the drawings in which:

While the present invention will be described hereinafter in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Figure 1:
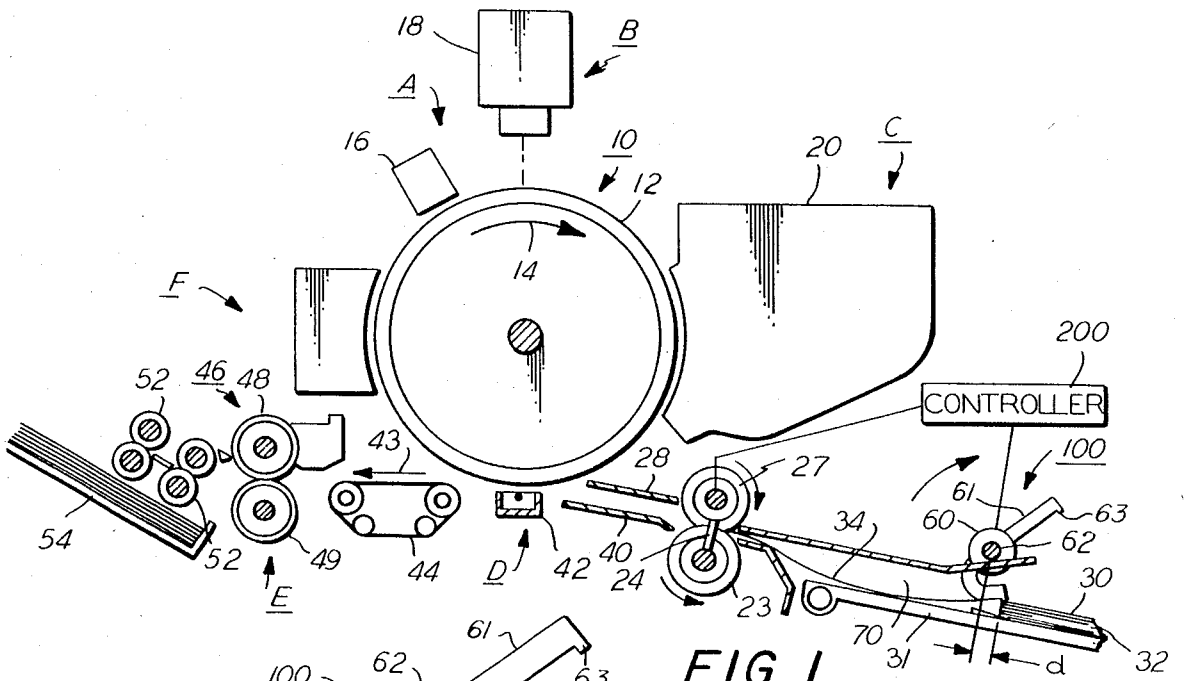
FIG. 1 is a schematic elevational view of an electrophotographic printing machine incorporating the feeder of the present invention.

For a general understanding of an electrophotographic printing machine in which the features of the present invention may be incorporated, reference is made to FIG. 1, which depicts schematically the various components thereof. Hereinafter, like reference numerals will be employed throughout to designate identical elements. Although the apparatus for forwarding sheets along a predetermined path is particularly well adapted for use in the electrophotographic printing machine of FIG. 1, it should become evident from the following discussion that it is equally well suited for use in a wide variety of devices and is not necessarily limited in its application to the particular embodiment shown herein. For example, the apparatus of the present invention will be described hereinafter with reference to feeding successive copy sheets, however, one skilled in the art will appreciate that it may be employed for feeding successive original documents.

Since the practice of electrophotographic printing is well known in the art, the various processing stations for producing a copy of an original document are represented in FIG. 1 schematically. Each process station will be briefly described hereinafter.

As in all electrophotographic printing machines of the type illustrated, a drum 10 having a photoconductive surface 12 entrained about and secured to the exterior circumferential surface of a conductive substrate is rotated in the direction of arrow 14 through the various processing stations. By way of example, photoconductive surface 12 may be made from selenium of the type described in U.S. Pat. No. 2,970,906 issued to Bixby in 1961. A suitable conductive substrate is made from aluminum.

Initially, drum 10 rotates a portion of photoconductive surface 12 through charging station A. Charging station A employs a corona generating device, indicated generally by the reference numeral 16, to charge photoconductive surface 12 to a relatively high substantially uniform potential. A suitable corona generating device is described in U.S. Pat. No. 2,836,725 issued to Vyverberg in 1958.

Thereafter drum 10 rotates the charged portion of photoconductive surface 12 to exposure station B. Exposure station B includes an exposure mechanism, indicated generally by the reference numeral 18, having a stationary, transparent platen, such as a glass plate or the like for supporting an original document thereon. Lamps illuminate the original document. Scanning of the original document is achieved by oscillating a mirror in a timed relationship with the movement of drum 10 or by translating the lamps and lens across the original document so as to create incremental light images which are projected through an apertured slit onto the charged portion of photconductive surface 12. Irradiation of the charged portion of photoconductive surface 12 records an electrostatic latent image corresponding to the information areas contained within the original document.

Drum 10 rotates the electrostatic latent image recorded on photoconductive surface 12 to development station C. Development station C includes a developer unit, indicated generally by the reference numeral 20, having a housing with a supply of developer mix contained therein. The developer mix comprises carrier granules with toner particles adhering triboelectrically thereto. Preferably, the carrier granules are formed from a magnetic material with the toner particles being made from a heat settable plastic. Developer unit 20 is preferably a magnetic brush development system. A system of this type moves the developer mix through a directional flux field to form a brush thereof. The electrostatic latent image recorded on photoconductive surface 12 is developed by bringing the brush of developer mix into contact therewith. In this manner, the toner particles are attracted electrostatically from the carrier granules to the latent image forming at toner powder image on photoconductive surface 12.

With continued reference to FIG. 1, a copy sheet is advanced by sheet feeding apparatus 100 to transfer station D. Sheet feed apparatus 100 advances successive copy sheets to forwarding registration rollers 23 and 27. Forwarding registration roller 27 is driven conventionally by a motor (not shown) in the direction of photoreceptor 12 and thereby also rotating idler roller 23 which is in contact therewith. In operation, feed device 100 operates to advance the uppermost substrate or sheet from stack 30 into registration rollers 23 and 27 and against registration fingers 24. Fingers 24 are actuated by conventional means in timed relation to an image on drum 10 such that the sheet resting against the fingers is forwarded toward the drum in synchronism with the image on the drum. A conventional registration finger control system is shown in U.S. Pat. No. 3,902,715 which is incorporated herein by reference to the extent necessary to practice this invention. After the sheet is released by fingers 24, it is advanced through a chute formed by guides 28 and 40 to transfer station D.

Continuing now with the various processing stations, transfer station D includes a corona generating device 42 which applies a spray of ions to the back side of the copy sheet. This attracts the toner powder image from photoconductive surface 12 to the copy sheet.

After transfer of the toner powder image to the copy sheet, the sheet is advanced by endless belt conveyor 44, in the direction of arrow 43, to fusing station E.

Fusing station E includes a fuser assembly indicated generally by the reference numeral 46. Fuser assembly 46 includes a fuser roll 48 and a backup roll 49 defining a nip therebetween through which the copy sheet passes. After the fusing process is completed, the copy sheet is advanced by conventional rollers 52 to catch tray 54.

Invariably, after the copy sheet is separated from photoconductive surface 12, some residual toner particles remain adhering thereto. Those toner particles are removed from photoconductive surface 12 at cleaning station F. Cleaning station F includes a corona generating device (not shown) adapted to neutralize the remaining electrostatic charge on photoconductive surface 12 and that of the residual toner particles. The neutralized toner particles are then cleaned from photoconductive surface 12 by a rotatably mounted fibrous brush (not shown) in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIG. 1 depicts the top feeder system in greater detail.

Figure 2:
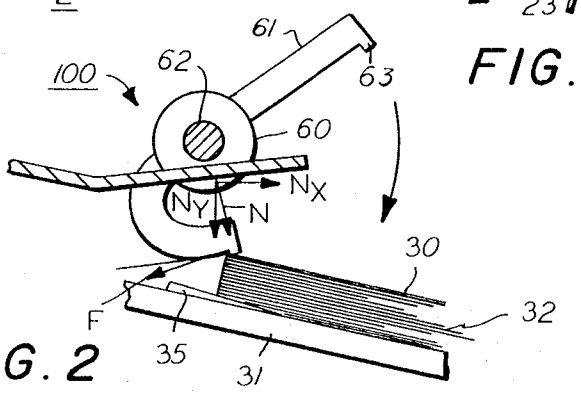
FIG. 2 is an enlarged partial side view of a paddle wheel in accordance with the present invention showing vector forces involved with sheet separation.
Figure 3:
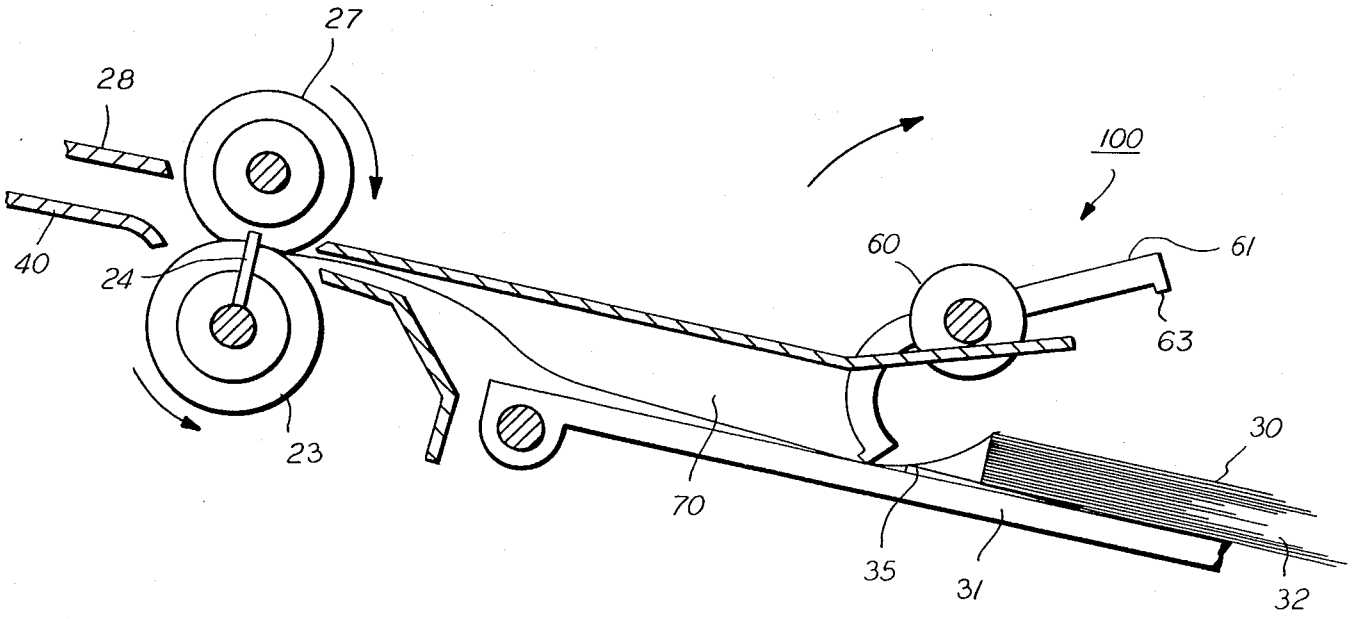
FIG. 3 is an enlarged side view of the feeder according to the present invention showing the use of a negative buckle chamber to provide an urging force to a sheet in the chamber.

Referring now more specifically to FIG. 1, the detailed structure and operation of an aspect of the present invention will be described. Sheets 32 of stack 30 are shown stacked on platform 31 so that a variable stack force can be obtained from blades 61 depending on the stack height. That is, a higher normal force is obtained when the stack is high with a decreasing normal force as the stack decreases in height. This aspect of the invention combines inertia, friction and retard mechanisms to separate and feed sheets from platform 31. Pushing the ON button of the copier actuates feeder 100 and paddle wheel 60. The rotation of the paddle wheel is controlled by a one revolution wrap spring clutch (not shown) which orientates the blades of the wheel parallel to the stack after rotation. As the paddle wheel rotates, blades 61 strike sheets 32 and due to the location of the shaft 62 a distance "d" of between 0.300–0.400 inches in front of stack 30, the positioning of tray 31 at an angle of approximately 15°–20° below the horizontal plane and the location and design of cork friction pad 35 extending partially under stack 30 only one sheet from the stack is fed to registration fingers 24. Also, whether the stack is high or low a buckle is created in the top sheet between the edge of the stack and the area immediately adjacent the edge of the stack that aids in separation of the top sheet. This buckle does not occur in the second sheet from the top of the stack. Blades 61 strike the stack of sheets 30 and through inertial separation, separates the top sheet in the stack from the remainder of the stack. Continued rotation of the paddle wheel blades 61 across the front edge of the stack causes all sheets other than the top sheet to remain in the stack, due to the bending or flexing of the blades down and in front of the stack while still touching the stack as shown in FIGS. 2 and 3. As the stack height decreases and the depth of the overhang of the blades over the stack edge decreases, single sheet separation is enhanced by the inclusion of frictioned surfaced pad 35 in the tray. Any prospective multi-feeds will be held back by the pad. In addition to retarding effects occurring by using the cork pad under the stack and extending therefrom, there is an effect created by the pad angle relative to the stack. If inclined upward as shown in FIG. 2 a wedging effect is created, i.e., the sheet is pinched between the pad and the blades of the paddle wheel. While the paddle wheel of the present invention is adapted to rotate one complete revolution in order to feed a sheet from the stack to the registration rolls, it should be understood that the paddle wheel could be adapted to rotate a part of a complete revolution or any number of revolutions depending on the distance between the front edge of the stack and the registration rolls. Blades 61 are flexible in order to insure a constant normal force against the stack.

As shown in FIG. 2, there are two blades 61 on shaft 62 and both are flexible such that their tips 63 strike the top of stack 30 and advance only the top sheet in the stack into buckle chamber 70. As the tip of a blade strikes the top of the stack and since the shaft on which the blade is mounted is positioned a short distance in front of the stack, the blade is flexed down along the front edge of the stack to thereby inhibit all sheets but the top sheet in the stack from movement out of the stack. Each blade 61 has a protruding tip portion or head 63 that in the preferable embodiment strikes the top of the stack in order to provide inertial separation of the top sheet from the rest of the stack without presenting a large friction area to the stack. This shape is less susceptible to wear than flat blades since only the blade head 63 contacts the stack. This shape of the blades also allows for several stack contacts at constant normal force before wear is noticeable.

As shown in FIGS. 2 and 3, a force vector N in the opposite direction of paper feeding is achieved by having blades 61 deflect below the front of the stack. N is used herein to represent the normal force. Initially, the force vector of the blades is in the $N_y$ direction, but as the blades continue in their arc across the stack and bend downward in front of the stack, a vector force component in the $N_x$ direction retards the movement of sheets other than the top sheet off the stack. In addition, the angle of the tray and the position of the stack lead edge in relation to the support shaft for the paddle wheel effects retardation. In action, as the first blade strikes the top of the stack, the first sheet follows the blade and rolls over the stack edge as the stack is compressed. After the blades are free of the stack, the stack reforms from the compression of the blades while vibrating. The vibration tends to force sheets other than the top sheet to settle into the back of the tray and thereby helps reduce multi-feeds.

In operation, the sheets are lead edge registered onto feed tray 31. Once the ON button is pushed, paddle wheel 60 rotates one complete revolution and advances the top sheet in the stack into negative buckle chamber 70 and then to registration stop 24 where it is deskewed and registered. The negative chamber is unique in that it provides an urging force to sheets fed toward the registration rolls. On demand, the paddle wheel is stopped and the registration rolls actuated through drive roll 27 to feed the sheet in synchronism with an image on photoreceptor 12. The stopping and starting of paddle wheel 60 and drive registration roll 27 is software controlled through a conventional microprocessor 200 such as used in the Xerox 1075 copier which disclosure is included herein by reference to the extent necessary to practice the invention. It should be understood that conventional mechanical means could be used to trigger the paddle wheel and registration rolls if desired. Such a mechanical system is disclosed in the Minolta 310P copier.

It should be evident from the disclosure above that a paddle retard feeder is shown which combines inertial separation and retard forces to feed sheets individually from a stack of sheets. The device utilizes an uphill paper path which offers resistance or retarding of sheets in the stack other than the top sheet. The stack is supported at a 15°–20° angle in relation to a paddle wheel which uses inertial separation to strip the top sheet off the stack. As an additional measure, the blades of the paddle wheel are adapted to deflect downward in front of the stack after a portion of the blades have passed the stack edge while another portion of blades are still on the stack. Thus, retarding of all sheets other than the top sheet is accomplished.

I claim:

1. An inertia friction retard feeder, comprising in combination:

tray means for holding a stack of sheets to be fed, said tray means being positioned at an angle of about 10° to 15° with respect to a horizontal plane;

friction surfaced means along the bottom of said tray means extending partially under the stack of sheets in said tray means and adapted to allow the stack of sheets to be placed thereon for feeding;

paddle wheel means positioned a predetermined distance in front of the stack and located in driving relation to all sheets in the stack, said paddle wheel means includes a plurality of blades mounted on a hub such that as said paddle wheel is rotated, said blades initially contact the top sheet in the stack in a first position and by inertial separation moves the top sheet in the stack along the stack and away from the other sheets in the stack and in a second position deflects downward in front of the stack to retard multi-feeding of the other sheets from the stack;

registration means for receiving a sheet fed from said stack and deskewing and registering the sheet for subsequent transport; and negative buckle chamber means adapted to provide an urging force to sheets buckled therein in order to positively position sheet against said registration means.

2. In a printer having a photoreceptor, a imaging system for forming images of documents on said photoreceptor, and a predetermined paper path, the improvement comprising:

tray means for holding a stack of sheets to be fed, said tray means being positioned at an angle of about 15° to 20° with respect to a horizontal plane;

friction surfaced means along the bottom of said tray means extending partially under the stack of sheets;

paddle wheel means positioned a predetermined distance in front of the stack and located in driving relation to all sheets in the stack, said paddle wheel means includes a plurality of blades mounted on a hub, such that as said paddle wheel is rotated said blades initially contact the top sheet in the stack in a first position and by inertial separation moves the top sheet in the stack away from the other sheets in the stack and in second position deflects downward in front of the stack to retard multi-feeding of the other sheets from the stack;

registration means for receiving a sheet fed from said stack and deskewing and registering the sheet for subsequent transport; and negative buckle chamber means adapted to provide an urging force to sheets buckled therein in order to positively position the sheets against said registration means.

3. The improvement of claim 2, wherein said negative buckle chamber means includes a portion of said tray means.

4. The improvement of claim 2, wherein the blades of said paddle wheel means force sheets against a portion of said friction surfaced means.

5. The improvement of claim 4, wherein said friction surfaced means is a wedge shaped cork pad.

6. A method of feeding sheets individually from a stack, comprising the steps of:

providing a tray for holding a stack of sheets for feeding;

supporting said tray at an angle with respect to a horizontal plane;

providing a friction surfaced pad on the bottom of said tray that extends partially from under the stack of sheets to enhance the feeding of sheets individually from low stack heights; and positioning a paddle wheel having a plurality of blades a predetermined distance in front of said tray such that as said paddle wheel is rotated the blades in a first position will strike the top sheet of a stack of sheets stacked in said tray and in a second position will strike the front edge of the stack of sheets deflect downward in front of the stack to such an extent that all sheets other than the top sheet are prevented from leaving the stack.

7. The method of claim 6, including the step of providing a negative buckle chamber immediately adjacent the stack of sheets in said tray.

8. The method of claim 7, wherein said tray is a part of said negative buckle chamber.

9. An inertia friction retard feeder, comprising in combination:

tray means for holding a stack of sheets to be fed; and paddle wheel means rotatably mounted on a shaft with said shaft being positioned a predetermined distance in front of the front edge of sheets stacked in said tray means, said paddle wheel means including a plurality of blades that are adapted to initially strike the top sheet of the stack of sheets remote from the edge of the stack of sheets and afterwards deflect downward along the front edge of the stack of sheets in order to inhibit multi-feeding of sheets.

10. The inertia friction retard of claim 9, including friction surfaced means positioned in said tray means to extend partially under the stack of sheets and partially in front of the stack of sheets.

11. The inertia friction retard feeder of claim 10, including a negative buckle chamber positioned in front of the front edge of sheets stacked in said tray means.

12. The inertia friction retard feeder of claim 9, wherein said shaft is positioned a distance of between 0.300"–0.400" in front of the stack of sheets.

13. The inertia friction retard feeder of claim 9, wherein said plurality of paddle wheel blades have protrusions on their extremeties that serve as the contact portions against the top sheet in the stack of sheets in order to provide a longer wear cycle for said plurality of blades.

* * * * *